US007121096B2

(12) United States Patent
Westlake et al.

(10) Patent No.: US 7,121,096 B2
(45) Date of Patent: Oct. 17, 2006

(54) GAS TURBINE ENGINE COMBUSTOR

(75) Inventors: Michael Westlake, Gloucestershire (GB); Samuel M. Sampson, Bristol (GB)

(73) Assignee: Rolls-Royce PLC, London (GB)

( * ) Notice: Subject to any disclaimer, the term of this patent is extended or adjusted under 35 U.S.C. 154(b) by 179 days.

(21) Appl. No.: 10/769,780

(22) Filed: Feb. 3, 2004

(65) Prior Publication Data

US 2004/0231336 A1 Nov. 25, 2004

(30) Foreign Application Priority Data

Mar. 14, 2003 (GB) ..... 0305868.2

(51) Int. Cl.
*F02C 7/18* (2006.01)
*F23R 3/06* (2006.01)

(52) U.S. Cl. ..... 60/752; 60/754; 60/804

(58) Field of Classification Search ..... 60/752, 60/754, 804, 39.37
See application file for complete search history.

(56) References Cited

U.S. PATENT DOCUMENTS 3,886,735 A * 6/1975 Irwin ..... 60/753
3,899,882 A * 8/1975 Parker ..... 60/752
4,343,355 A * 8/1982 Goloff et al. ..... 165/166
4,700,544 A * 10/1987 Fucci ..... 60/757
5,524,430 A * 6/1996 Mazeaud et al. ..... 60/798
5,560,197 A * 10/1996 Ansart et al. ..... 60/800
6,681,577 B1 * 1/2004 Bolender et al. ..... 60/754

FOREIGN PATENT DOCUMENTS

| | | |
|---|---|---|
| EP | 0 318 312 A1 | 5/1989 |
| GB | 2 003 989 A | 3/1979 |
| GB | 1 605 202 | 7/1983 |
| GB | 2 377 487 A | 1/2003 |
| GB | 2 379 499 A | 3/2003 |

* cited by examiner

*Primary Examiner*—Ted Kim
(74) *Attorney, Agent, or Firm*—Oliff & Berridge, PLC

(57) ABSTRACT

A combustor for a gas turbine engine comprising a combustion chamber wall having formed therein at least one hole for admitting air into the combustion chamber and at least one air intake chute aligned with said hole. The air intake chutes are attached to the combustor wall in regions which, during operation, will be regions of low stress concentration.

7 Claims, 2 Drawing Sheets

GAS TURBINE ENGINE COMBUSTOR

The invention relates to a combustor for a gas turbine engine.

In particular it concerns a combustor with an improved air intake chute configuration and a method of manufacture of such a combustor.

The majority of the air entering a combustor enters at the upstream (front) end, usually close to the fuel injection points. The air mixes with and aids the vaporisation of the fuel, which then ignites and burns. Throughout this process the bulk motion of the combusting gas is from the front to the back of the combustor, exiting to the turbine.

This simple air and fuel mixing method does not achieve complete combustion and may result in undesirable unburned carbon and hydrocarbon emissions as well as a non optimal turbine entry temperature profile. A commonly used solution to this situation is to pierce the combustor wall with a plurality of plain holes to provide extra, or 'dilution', air to complete the combustion process. However, because the holes direct relatively small quantities of air into the combustor, usually perpendicular to the bulk flow, the momentum of the dilution air is much lower and therefore will have an insufficient penetration depth to be fully effective. An improvement can be obtained by employing air intake chutes in the holes to shield the dilution air from the main gas flow and help turn the air direction to a steep angle to the main flow.

The air intake chute comprises a tubular section with a flange at one end. The flange has a greater diameter than the hole it is associated with and typically, is attached to the combustor by a number of welds around the flange edge. The location and lengths of the welds are chosen by the operator executing the weld. For practical reasons, such as visibility, especially during a manual welding operation, the weld size will vary in size and location on each air intake chute.

It will be appreciated that stress will be induced in the combustor walls during operation of the gas turbine combustor. The most dominant component of this is the hoop stress. It will also be appreciated that the hoop stress will be concentrated by the air intake holes. Hence it is highly likely that the welds will be positioned in zones of high stress. In such a configuration it is common for cracks to initiate at the weld location which propagate through the combustor wall. This may result in serious damage to the combustor and, consequently, the engine.

According to the present invention there is provided a combustor for a gas turbine engine comprising a combustion chamber wall having formed therein at least one hole for admitting air into the combustion chamber; at least one air intake chute aligned with said hole; during operation a hoop stress field having regions of high and low stress concentration around said hole; wherein said chute is attached to the combustor wall in a region of low stress concentration.

Preferably the chute is attached to the combustor wall in at least two regions of low stress concentration.

Preferably the chute is provided with a flange disposed around one end thereof.

Preferably at least one tab projects from the outer edge of said flange, and the at least one tab is attached to the combustor wall.

According to a second aspect of the invention there is provided a method of manufacturing a combustor as described in any of the preceding four paragraphs comprising the step of aligning the areas where the chute is attached to the combustor with the operational hoop stress field in the combustor wall.

Preferably the areas where the chute is attached to the combustor wall are orientated such that they are in the same radial plane.

Hereinbefore and hereafter a radial plane is taken to mean a plane perpendicular to the longitudinal axis of the engine and/or combustor.

The invention is a combustor and a method of manufacturing the combustor, provided with air intake chutes which are aligned such that the areas where the chute is attached to the combustor wall are positioned away from the regions of concentrated hoop stress which are induced in the combustor walls during operation.

The invention, and how it may be carried into practice will now be described in greater detail with reference by way of example to embodiments illustrated in the accompanying drawings, in which:

FIG. 1 is sectional view of a gas turbine engine combustor 2. The overall construction and operation of the engine is of a conventional kind, well known in the field, and will not be described in this specification beyond what is necessary to gain an understanding of the invention.

Figure 1:
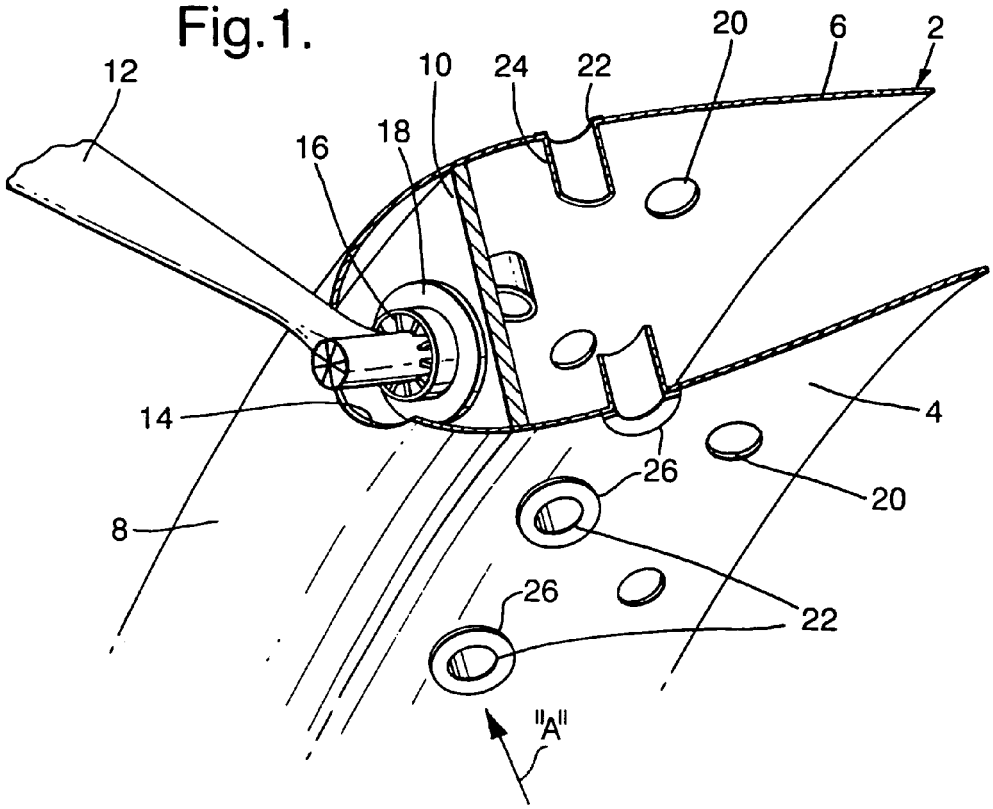
FIG. 1 shows a section of a gas turbine engine combustor having a plurality of air intake chutes according to the present invention.

The combustor 2 comprises an inner wall 4 and an outer wall 6, joined by a cowl 8 and a metering panel 10. A fuel injector 12 extends through the cowl 8 through a hole 14 where the fuel injector head 16 locates inside a sleeve 18 in the metering panel 10, leaving the end of the injector exposed to the combustion region. The injector head 16 comprises an aperture through which fuel will flow and air passages to allow air entry into the combustion region.

In this example there are two rows of holes 20,22 spaced around the circumference of the walls 4,6. Attached to the walls 4,6 and aligned with holes 22 are chutes 24. These may be cylindrical, the same diameter as hole 22 and have a scarfed end. The chutes 24 are provided with a flange 26 at one end which is of larger diameter than the holes 22. The flange 26, and hence the chute 24, is attached to the combustor wall 4,6 by some suitable attachment means. The flange 26 may, by way of non-limiting example, be welded to the combustor wall 4,6.

In operation, pressurised high velocity air from the engine compressor (not shown) upstream of the combustor 2 is split into three flow paths as it reaches the combustor 2. Some of the air passes though the hole 14 around the fuel injector and through the air passages in the fuel injector head 16 into the combustion region. The majority of the remaining air passes either around the inside of the combustion chamber 2, constrained by the combustor inner (not shown), or passes around the outside of the combustion chamber 2, constrained by the combustor outer casing (not shown) before entering the combustion chamber through holes 20,22.

The combustion process occupies the whole of the combustion chamber 2 but, expressed crudely, can be divided up into a core combustion region (of low air fuel ratio) immediately down stream of the metering panel 10 and a dilution region (of higher air fuel ratio) occupying approximately the latter two thirds of the combustion region before the gas exits the combustor 2 to the turbine (not shown). Holes 20,22 provide air for the dilution. Chutes 24 are required to achieve the required penetration to effectively dilute the combustion region.

It will be appreciated that there is a significant pressure drop between the outside and the inside of the combustor 2 and that the combustor 2 is operating over a wide temperature range. A significant hoop stress is induced in the combustor walls 4,6.

Figure 2:
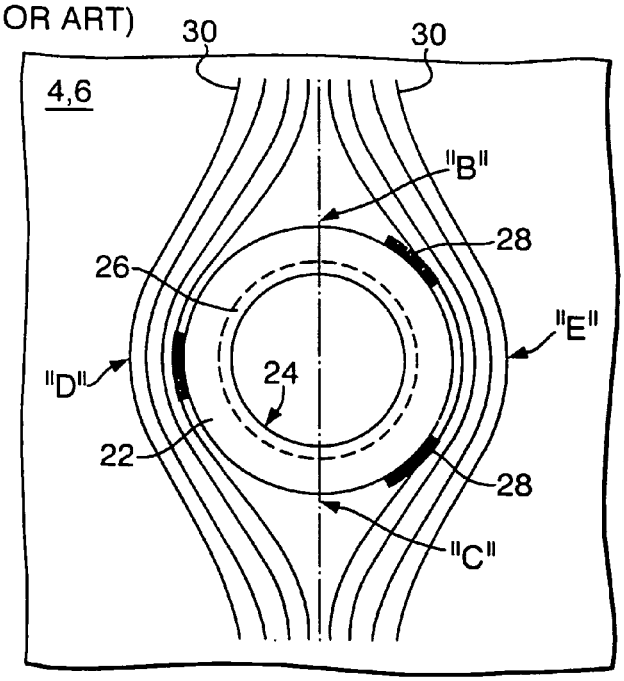
Fig.2. (PRIOR ART)
FIG. 2 (Prior Art) is a diagrammatic view of an air intake chute attachment means.

Conventionally the chutes 24 are welded at a plurality of locations 28 around the circumference of the flange 26, as shown in FIG. 2 (prior art). The hoop stress field is represented by lines 30 running circumferentially around the combustor wall 4, 6. Hence point "B" and "C" marked on the center line 30 are in the same radial plane.

It is well known that with this configuration, the hole 22 will concentrate the hoop stress. The regions of peak stress are located at regions indicated by "D" and "E". However, regions of low stress, or "dead zone" are located in regions "B" and "C".

Figure 3:
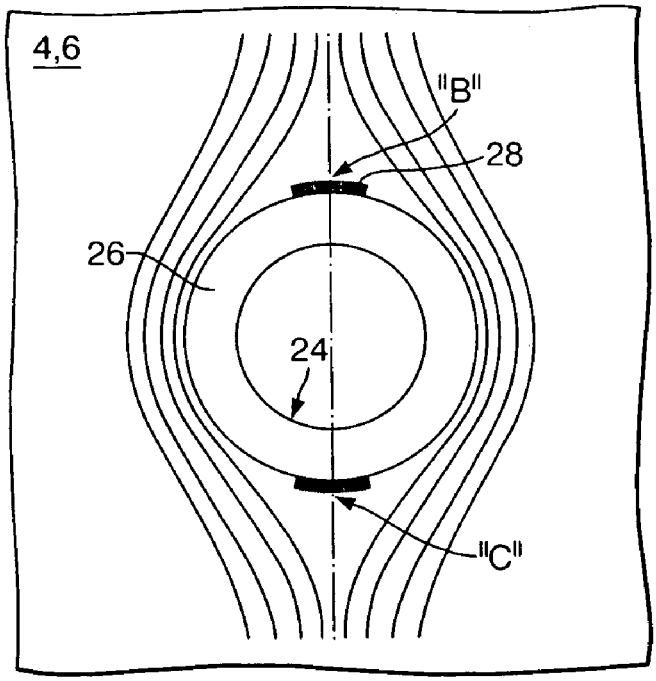
FIG. 3 is a diagrammatic view in the direction of the arrow "A" in FIG. 1

Shown in FIG. 3 and in accordance with the present invention, is a similar arrangement to that described in the prior art except that the areas where the chute 24 is attached to the combustor wall 4,6 are located only in the regions of low stress "B","C" which are positioned in the same radial plane and are provided on diametrically opposite sides of the chute 24 and flange 26.

In operation, the present invention will reduce the propensity for weld cracks at the areas of attachment 28. It will be appreciated that cracks initiated at the areas of attachment 28 may propagate to the combustor wall 4, 6, resulting in a critical failure of the combustor 2.

Figure 4:
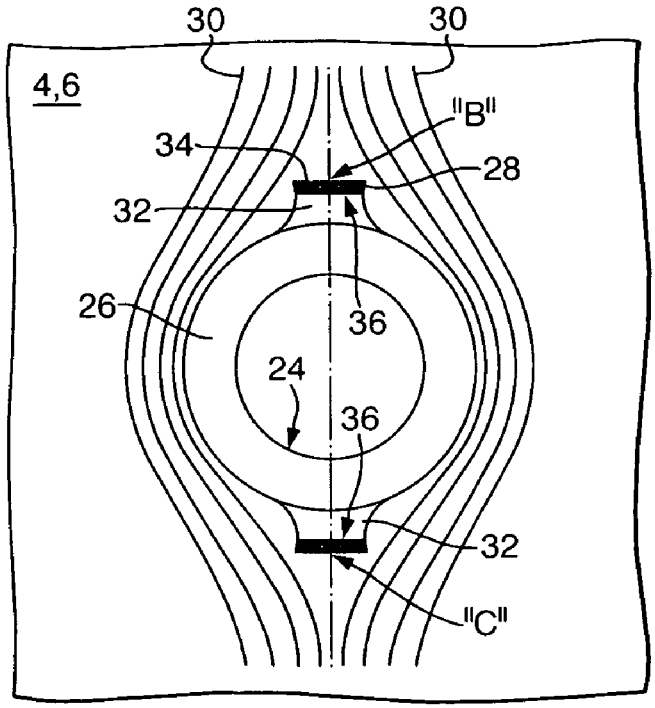
FIG. 4 is a diagrammatic view of an alternative embodiment in the direction of the arrow "A" in FIG. 1

An alternative embodiment of the flange 26 is presented in FIG. 4. Tabs 32 are provided such that they project outwardly from the flange 26. The tabs 32 are positioned on diametrically opposite sides of the flange 26 such that when attached to the combustor wall 4,6 they are in the same radial plane.

In this embodiment the flange 26 is attached to the combustor wall 4,6 by welding means. The weld 34 is provided along the outermost edge 36 of the tab 32. The edge 36 may be flat or curved.

It will be appreciated that it is critical to control the length of weld 34 in order to position the attachment point in the regions of low stress "B" and "C". During a manual welding operation the edge 36 enables the weld operator to identify the beginning and end of the desired weld position. This embodiment offers the surprising advantage that the edge 36 provides a guide for the location and length of the weld during the weld operation.

The size of the tabs 32 are chosen such that the weld 34 is positioned in the low stress regions "B" and "C". It will be appreciated that the tab 32 size will be different for different combustor configurations. However, by way of non limiting example, tab 32 projects up to about 0.14× (flange 26 diameter) and should have a length up to about 0.25× (flange 26 diameter).

It will be appreciated that the tab 32 may be attached to the combustor wall 4,6 by suitable attachment means other than welding.

The configurations shown in FIGS. 1 to 4 are diagrammatic. The design of the combustor and air intake chute may vary. Likewise the combination, configuration and positioning of these components relative to one another will vary between designs.

The invention claimed is:

1. A combustor for a gas turbine engine, comprising:

a combustion chamber wall having formed therein at least one hole for admitting air into the combustion chamber;

at least one air intake chute aligned with said hole;

during operation a hoop stress field having regions of high and low stress concentration around said hole;

wherein said chute is provided with a flange disposed around one end thereof, and at least one tab that projects from the outer edge of said flange and is welded to the combustor wall in a region of low stress concentration along the outer edge of the at least one tab such that the at least one tab provides a guide for the location and length of the weld.

2. A combustor as claimed in claim 1 wherein the chute is attached to the combustor wall in at least two regions of low stress concentration.

3. A combustor as claimed in claim 2 wherein areas where the chute is attached to the combustor wall are substantially in the same radial plane.

4. A combustor as claimed in claim 2 wherein the areas of attachment are provided on diametrically opposite sides of said chute.

5. A combustor as claimed in claim 1 wherein the flange is circular.

6. A combustor as claimed in claim 1 wherein the at least one tab projects from the edge of the flange up to about 0.14× (flange diameter).

7. A combustor as claimed in claim 1 wherein the at least one tab has a length of up to about 0.25× (flange diameter) of the diameter of the flange.

* * * * *